US008721040B2

(12) United States Patent
Tanaka

(10) Patent No.: US 8,721,040 B2
(45) Date of Patent: May 13, 2014

(54) LIQUID COLLECTION CONTAINER AND LIQUID EJECTING APPARATUS

(75) Inventor: Takeshi Tanaka, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 136 days.

(21) Appl. No.: 13/236,519

(22) Filed: Sep. 19, 2011

(65) Prior Publication Data

US 2012/0069087 A1 Mar. 22, 2012

(30) Foreign Application Priority Data

Sep. 21, 2010 (JP) ..... 2010-210513
Jun. 20, 2011 (JP) ..... 2011-136008

(51) Int. Cl.
*B41J 2/17* (2006.01)

(52) U.S. Cl.
CPC ..... *B41J 2/1721* (2013.01); *B41J 2002/1728* (2013.01)
USPC ..... 347/36

(58) Field of Classification Search
CPC ..... B41J 2002/1728; B41J 2/1721
USPC ..... 347/36
See application file for complete search history.

(56) References Cited

U.S. PATENT DOCUMENTS 6,203,137 B1 * 3/2001 Niimura et al. ..... 347/36
2006/0017770 A1 1/2006 Harada et al.
2007/0252864 A1 11/2007 Uchino
2008/0100679 A1 * 5/2008 Tyvoll et al. ..... 347/85
2009/0315943 A1 * 12/2009 Ohnishi et al. ..... 347/36
2010/0007695 A1 * 1/2010 Miyazawa ..... 347/30
2010/0020125 A1 * 1/2010 Miyazawa ..... 347/30
2010/0283815 A1 * 11/2010 Watanabe ..... 347/30

FOREIGN PATENT DOCUMENTS

JP 2005119210 A * 5/2005
JP 2006044243 A * 2/2006
JP 2006-218846 8/2006
JP 2007-296757 11/2007
JP 2008179118 A * 8/2008
JP 2010184503 A * 8/2010

OTHER PUBLICATIONS

Machine generated English translation of JP2006-044243A to Hayakawa et al., "Liquid Recovery Body and Liquid Ejector"; generated via http://www19.ipdl.inpit.go.jp/PA1/cgi-bin/PA1INDEX on Jun. 6, 2013; 11pp.*

Machine generated English translation JP2010-184503A to Hara Kazuhiko, "Inkjet Recorder"; generated via http://wwww.ipdl.inpit.go.jp/homepg_e.ipdl on Sep. 30, 2013; 9pp.*

* cited by examiner

*Primary Examiner* — Shelby Fidler
(74) *Attorney, Agent, or Firm* — Workman Nydegger

(57) ABSTRACT

A waste ink tank which is capable of collecting discharged ink includes an ink absorbing material which absorbs discharged ink and a recess which makes a suction force act on the ink absorbing material.

9 Claims, 11 Drawing Sheets

LIQUID COLLECTION CONTAINER AND LIQUID EJECTING APPARATUS

BACKGROUND

1. Technical Field

The present invention relates to a liquid collection container which can receive liquid and a liquid ejecting apparatus including the liquid collection container.

2. Related Art

An ink jet printer (hereinafter, simply referred to as "printer") has been widely known as an existing liquid ejecting apparatus which ejects liquid onto a target through nozzle openings formed on a liquid ejecting head. In such a printer, so-called cleaning is normally performed in order to suppress clogging of the nozzle openings due to ink (liquid) of which viscosity has been increased, discharge air bubbles and dusts mixed into the ink in the recording head (liquid ejecting head), and so on (for example, see JP-A-2007-296757). In the cleaning, the ink of which viscosity has been increased is forcibly sucked from the recording head as waste ink (liquid) so as to be discharged.

In the printer as described in JP-A-2007-296757, a waste ink tank is provided in the printer in a detachable manner. The waste ink which has been forcibly sucked from the recording head by the cleaning is discharged to the waste ink tank (liquid collection container) through a flexible tube. The waste ink tank is arranged at a predetermined place in the printer. The flexible tube functions as a liquid flow path. Further, the waste ink is absorbed by a waste ink absorbing material (liquid absorbing material) accommodated in the waste ink tank.

In the printer as described in JP-A-2007-296757, the waste ink which has been discharged to the waste ink tank and absorbed by the waste ink absorbing material is easy to permeate to a lower side on the waste ink absorbing material by the gravity force. On the other hand, such waste ink is difficult to permeate in the horizontal direction or to an upper side from a discharged place. Therefore, the waste ink becomes localized at a lower portion of the waste ink absorbing material and the waste ink cannot be dispersed to the entire region of the waste ink absorbing material. Accordingly, there has arisen a risk that the waste ink cannot be sufficiently absorbed by the waste ink absorbing material.

SUMMARY

An advantage of some aspects of the invention is to provide a liquid collection container which can collect liquid sufficiently and a liquid ejecting apparatus including the liquid collection container.

A liquid collection container according to an aspect of the invention which is capable of collecting discharged liquid includes a liquid absorbing material which absorbs the discharged liquid, and a suction action portion which makes a suction force act on the liquid absorbing material.

With the above configuration, discharged liquid is dispersed not only by the gravity force and the permeation capability of the liquid absorbing material but also by the suction force acting on the liquid absorbing material. Therefore, the discharged liquid can be permeated into and dispersed to regions to which the discharged ink is difficult to be dispersed by the gravity force and the permeation capability. Accordingly, the liquid absorbing material can sufficiently absorb the liquid. Further, permeation by the suction force is faster than permeation by the gravity force and the permeation capability. Therefore, the liquid can be made to permeate into an extensive range of the liquid absorbing material for a shorter period of time by the suction force.

Further, in the liquid collection container according to another aspect of the invention, it is preferable that the height of the suction action portion in the vertical direction be higher than the height of a reception portion which receives the discharged liquid.

With the above configuration, the suction action portion disperses the liquid received on the reception portion to the upper side in the vertical direction against the gravity force in the liquid absorbing material. Therefore, the liquid can be dispersed to more upper side in comparison with a case of dispersion to the upper side in the vertical direction without the suction force. Accordingly, the liquid absorbing material can sufficiently absorb the liquid.

Further, in the liquid collection container according to another aspect of the invention, it is preferable that the suction action portion and the reception portion be provided at both sides of the liquid absorbing material so as to be separated from each other in the horizontal direction.

A suction force acting by the suction action portion is weaker at the side closer to the reception portion and is stronger at the side farther from the reception portion. On the other hand, the discharged liquid is easy to permeate into the liquid absorbing material at the side closer to the reception portion and is difficult to permeate into the liquid absorbing material at the side farther from the reception portion. With the above configuration, a strong suction force acts on the liquid which is farther from the reception portion and is difficult to permeate into the liquid absorbing material and a weak suction force acts on the liquid which is closer to the reception portion and is easy to permeate into the liquid absorbing material. Therefore, the liquid can be made to permeate into the entire liquid absorbing material.

Further, in the liquid collection container according to another aspect of the invention, it is preferable that the suction action portion and the reception portion be provided on both side surfaces of the liquid absorbing material in the horizontal direction, and the suction action portion be provided at the same height as the reception portion.

With the above configuration, the discharged liquid is dispersed upon reception of all the gravity force, the permeation capability, and the suction force. Therefore, the liquid absorbing material absorbs the liquid through an extensive portion on the liquid absorbing material so that the liquid absorbing material can sufficiently absorb the liquid.

Further, in the liquid collection container according to another aspect of the invention, it is preferable that the suction action portion and the reception portion be provided on both side surfaces of the liquid absorbing material in the horizontal direction, and the suction action portion be provided at an upper position with respect to the reception portion.

With the above configuration, the suction action portion disperses liquid received on the reception portion to the upper side in the vertical direction against the gravity force and disperses the liquid in the direction farther from the reception portion. Therefore, the liquid absorbing material absorbs the liquid through an extensive portion on the liquid absorbing material so that the liquid absorbing material can sufficiently absorb the liquid.

Further, in the liquid collection container according to another aspect of the invention, it is preferable that the suction action portion and the reception portion be provided on the same side surface of the liquid absorbing material, and the suction action portion be provided at an upper position with respect to the reception portion.

With the above configuration, the suction action portion disperses liquid received on the reception portion to the upper side in the vertical direction against the gravity force. Then, the liquid absorbing material disperses the liquid dispersed in the up-down direction in the direction farther from the reception portion in the horizontal direction. Therefore, the liquid absorbing material absorbs the liquid through an extensive portion on the liquid absorbing material so that the liquid absorbing material can sufficiently absorb the liquid.

Further, in the liquid collection container according to another aspect of the invention, it is preferable that the suction action portion make a suction force act on the liquid absorbing material from the upper side in the vertical direction at a plurality of positions sandwiching the reception portion in the horizontal direction.

With the above configuration, the suction action portion disperses liquid received on the reception portion to the upper side in the vertical direction against the gravity force at the plurality of positions sandwiching the reception portion in the horizontal direction. Therefore, the liquid absorbing material absorbs the liquid through an extensive portion on the liquid absorbing material so that the liquid absorbing material can sufficiently absorb the liquid.

A liquid ejecting apparatus according to another aspect of the invention includes a liquid ejecting head which ejects liquid onto a target, the liquid collection container having the above configuration, a discharge portion which sucks the liquid from the liquid ejecting head and discharges the liquid to the liquid collection container, and a suction unit which generates a suction force on the liquid collection container.

With the above configuration, the same effects as those obtained in the liquid collection container according to the above aspect of the invention can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment in which the invention is embodied to an ink jet printer as one type of a liquid ejecting apparatus to which a liquid collection container can be detachably attached is described with reference to drawings. It is to be noted that "front-rear direction", "up-down direction", and "right-left direction" referred to in the following description correspond to "front direction", "up direction", and "right direction" as indicated by arrows in FIG. 1, unless otherwise specially stated.

Figure 1:
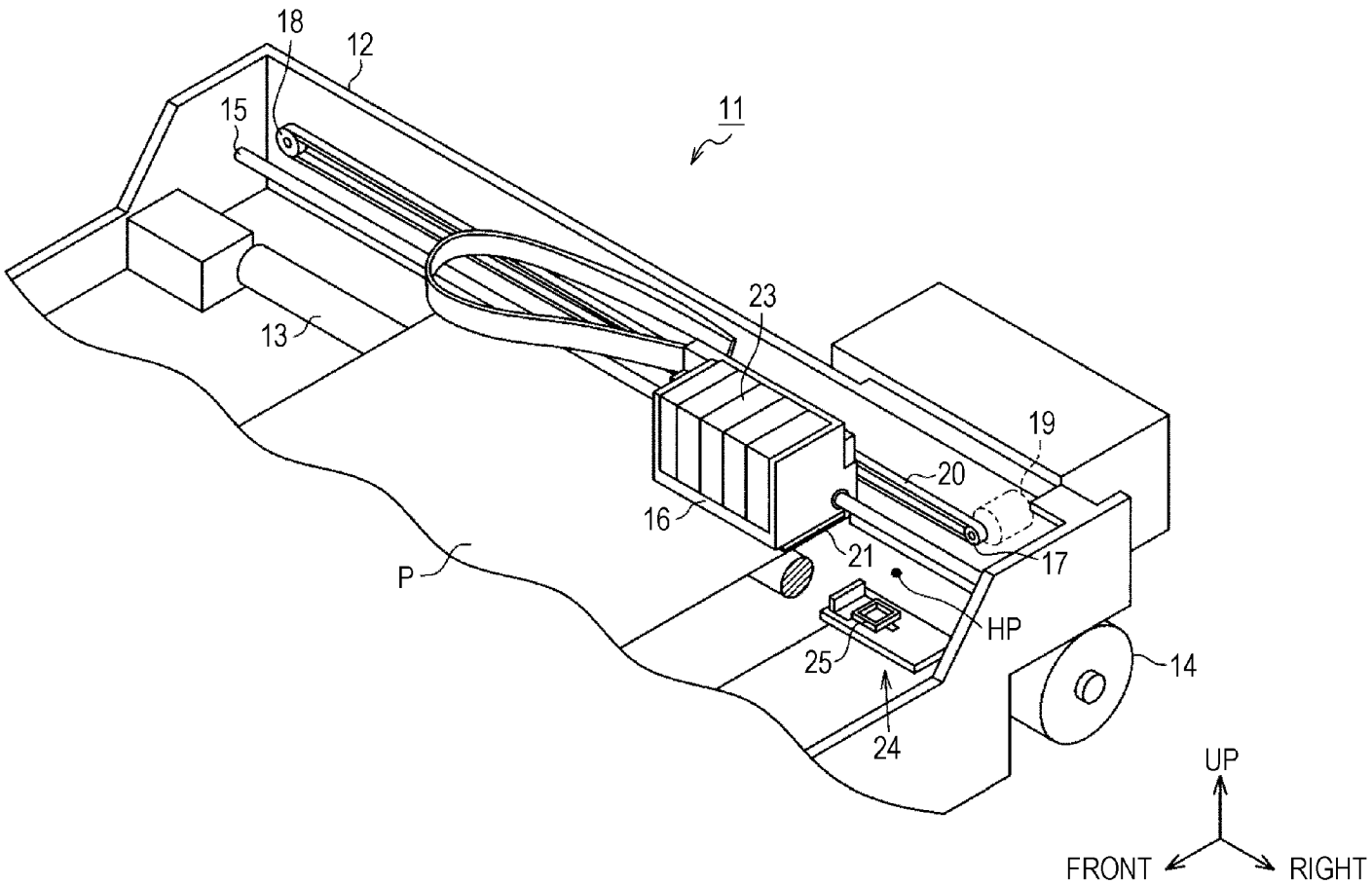
FIG. 1 is a partial cutaway perspective view illustrating a printer according to a first embodiment.

As illustrated in FIG. 1, an ink jet printer (hereinafter, referred to as "printer") 11 as a liquid ejecting apparatus according to the embodiment includes a frame 12 having a rectangular shape when seen from above. A supporting table 13 is provided in the frame 12 so as to extend in the right-left direction. A recording paper P is fed onto the supporting table 13 from a rear side to a front side by a paper feeding mechanism having a paper feeding motor 14. Further, a guide shaft 15 is bridged above the supporting table 13 in the frame 12. The guide shaft 15 extends so as to be in parallel with a lengthwise direction (right-left direction) of the supporting table 13.

A carriage 16 is supported by the guide shaft 15 so as to reciprocate along an axial line direction (right-left direction) of the guide shaft 15. Further, a driving pulley 17 and a driven pulley 18 are rotatably supported on the back surface in the frame 12 at positions corresponding to both ends of the guide shaft 15. A carriage motor 19 is coupled to the driving pulley 17. The carriage motor 19 serves as a driving source when the carriage 16 is reciprocated. A timing belt 20 fixing the carriage 16 is stretched up between a pair of the pulleys 17, 18. Accordingly, the carriage 16 moves in the right-left direction through the timing belt 20 while being guided by the guide shaft 15 by driving the carriage motor 19.

As illustrated in FIG. 1, a recording head 21 as a liquid ejecting head is provided on the lower surface of the carriage 16. On the other hand, a plurality of (five in the embodiment) ink cartridges 23 for supplying ink as liquid to the recording head 21 are detachably mounted on the carriage 16. Each of these ink cartridges 23 individually corresponds to a plurality of rows of nozzle openings (not illustrated) formed on a nozzle formation surface 21*a* (see, FIGS. 2A and 2B) formed on the lower surface of the recording head 21. Further, each of these ink cartridges 23 individually supplies ink to the corresponding nozzle rows through ink flow paths (not illustrated) formed in the recording head 21.

Further, a home position HP is set to one end (right end in FIG. 1) in the frame 12, that is, to a non-printing region to which the recording paper P does not reach. The home position HR corresponds to a maintenance position at which the carriage 16 is positioned when the printer 11 is powered off or a maintenance operation is performed on the recording head 21. Further, a maintenance unit 24 is provided at the lower side of the home position HP. The maintenance unit 24 performs various maintenance operations for preferably maintaining ink ejection onto the recording paper P from the recording head 21.

The maintenance unit 24 has a cap 25, a discharge tube 26, a suction pump 27, and a raising/lowering device (not illustrated). The cap 25 as a liquid reception portion receives waste ink discharged through nozzles of the recording head 21. The discharge tube 26 is connected to the cap 25. The suction pump 27 sucks the contents of the cap 25 through the discharge tube 26. The elevating device is a device for moving up and down the cap 25. When the cap 25 is moved up based on the driving of the raising/lowering device in a state where the carriage 16 is moved to the home position HP, the cap 25 abuts against the nozzle formation surface 21*a* as the lower surface of the recording head 21 in a state of surrounding each nozzle row. Further, when the suction pump 27 is driven in a state where the cap 25 abuts against the nozzle formation surface 21*a* of the recording head 21, a negative pressure is accumulated in the cap 25. With this, ink is sucked through the nozzles of the recording head 21 so as to be collected into a waste ink tank 28 as a liquid collection container. In the embodiment, the cap 25, the discharge tube 26 and the suction pump 27 are collectively referred to as a discharge portion.

Figure 2A:
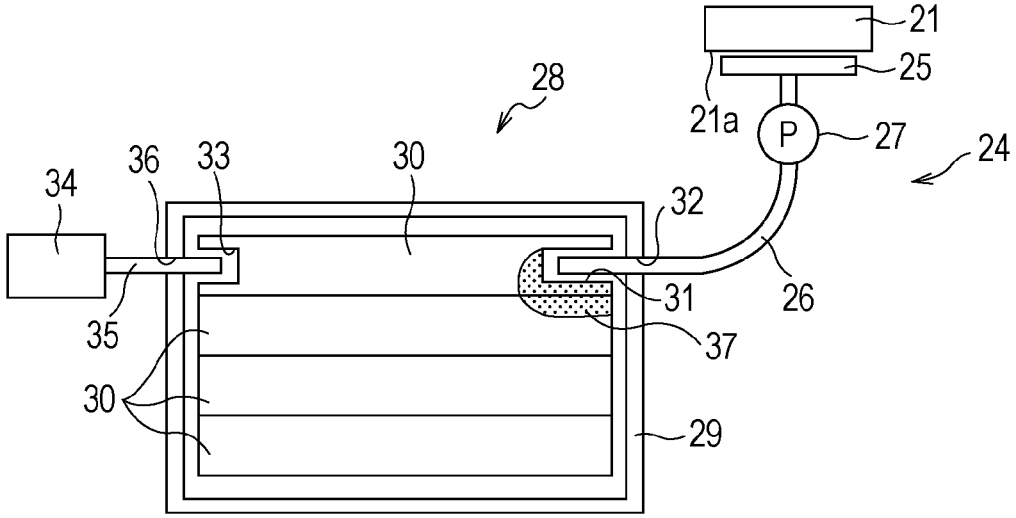
FIG. 2A is a schematic view illustrating a maintenance unit according to the first embodiment, which is seen from the front side.
Figure 2B:
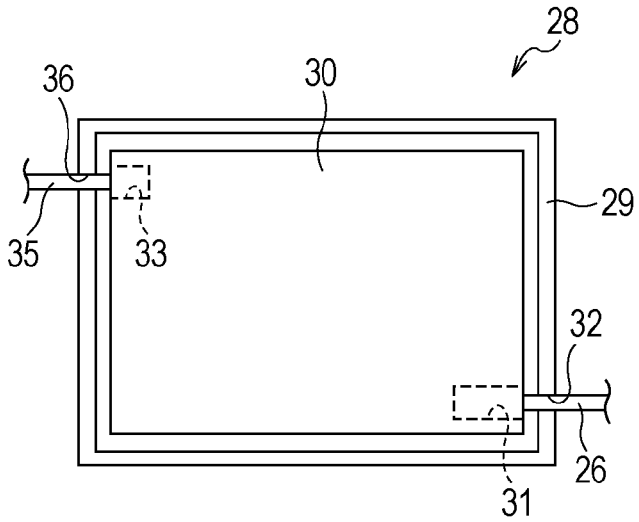
FIG. 2B is a schematic view illustrating the maintenance unit according to the first embodiment, which is seen from above.

As illustrated in FIGS. 2A and 2B, the waste ink tank 28 includes a tank main body 29 having a substantially box shape. Further, ink absorbing materials 30 as four liquid absorbing materials are laminated in the up-down direction and accommodated in the tank main body 29. Each of the ink absorbing materials 30 has a flat plate shape and is made of a porous material. A recess 31 is formed on a side surface of the ink absorbing material 30 located at an uppermost side among the ink absorbing materials 30. An end of the discharge tube 26 at a downstream side is inserted into the recess 31 of the ink absorbing material 30 through a through-hole 32 formed on a side surface of the tank main body 29. Ink discharged from the end of the discharge tube 26 at the downstream side is discharged to the recess 31.

A recess 33 is formed on a side surface of the ink absorbing material 30, which is opposite to the side surface on which the recess 31 is formed. The recess 33 is opposed to the recess 31 in a diagonal line direction of an upper surface of the ink absorbing material 30 when seen from above. Further, a front end of a decompression tube 35 extending from a decompression pump 34 is inserted into the recess 33 through a through-hole 36 formed on a side surface of the tank main body 29. Further, when the decompression pump 34 is driven, air is sucked from the ink absorbing materials 30 in the tank main body 29 through the decompression tube 35. That is to say, the recess 33 of the ink absorbing material 30 functions as a suction action portion which makes a suction force act on the ink absorbing materials 30. Further, the decompression pump 34 and the decompression tube 35 serve as a suction unit and the through-hole 36 serves as a connecting portion which connects the suction unit and the tank main body 29. In this case, ink discharged from the discharge tube 26 to the ink absorbing material 30 is dispersed upon reception of the gravity force, permeation capability of the ink absorbing materials 30, and a suction force from the side of the decompression tube 35. Note that the recess 31 and the recess 33 are formed on both side surfaces of the ink absorbing material 30 in the horizontal direction at the same height in the vertical direction.

It is to be noted that a slight clearance is ensured between the front end of the decompression tube 35 and an inner surface of the recess 33 of the ink absorbing material 30. Therefore, even if the decompression pump 34 sucks the ink absorbing materials 30 through the decompression tube 35, waste ink is prevented from being sucked into the decompression pump 34 through the decompression tube 35.

Next, actions of the printer 11 configured as described above are described hereinafter while particularly focusing on an action when waste ink discharged to the waste ink tank 28 is dispersed to the entire region of the ink absorbing materials 30. While the action is described, the discharge tube 26, the recess 31, the decompression tube 35, and the recess 33 are not described.

Figure 3A:
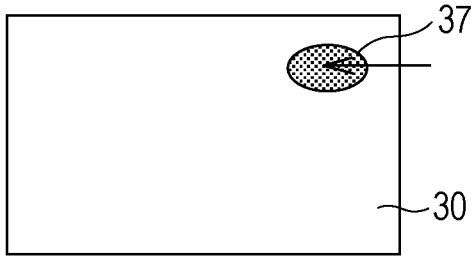
FIG. 3A is a schematic view illustrating a state immediately after waste ink has been received on an ink absorbing material.

If the maintenance unit 24 executes a maintenance operation on the recording head 21, waste ink is discharged to the ink absorbing material 30 from the cap 25 through the discharge tube 26. To be more specific, the waste ink is discharged to a portion of the ink absorbing material 30 at an upper right end as illustrated in FIG. 3A. Then, the waste ink discharged to the ink absorbing material 30 permeates into and is sucked by an inner surface of the recess 31 of the ink absorbing material 30 with a capillary force acting from the ink absorbing material 30 so that a reception portion 37 for receiving the waste ink is formed. It is to be noted that in the embodiment, the reception portion 37 for receiving the waste ink on the ink absorbing material 30 indicates, for example, a region at which the ink absorbing material 30 receives the waste ink at a time when approximately 30 seconds have passed since the waste ink was started to be dispersed from the discharge tube 26 to the ink absorbing material 30. Further, as illustrated in FIG. 2A, the reception portion 37 is located at the same height as the recess 33.

Figure 3B:
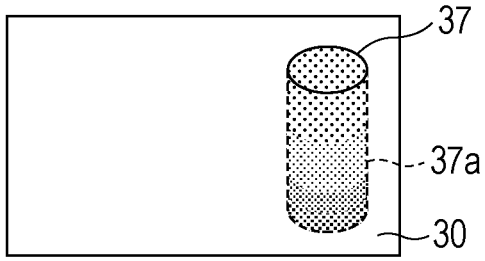
FIG. 3B is a schematic view illustrating a state where the waste ink is dispersed to the lower side in the vertical direction from the state as illustrated in FIG. 3A.

When the decompression pump 34 is not driven, the waste ink contained in the reception portion 37 is dispersed to the lower side in the vertical direction by the gravity force as indicated by a dotted line in FIG. 3B. The waste ink is dispersed to the lower side in the above manner because the gravity force is larger than the permeation capability by which the waste ink is dispersed in the horizontal direction in the ink absorbing materials 30. The waste ink is dispersed slowly over several hours to several days. In this case, a gradient (absorption rate) of a waste ink amount is formed on a region 37*a* where the waste ink is dispersed on the ink absorbing materials 30. The gradient (absorption rate) of the waste ink amount becomes gradually larger from the upper side to the lower side.

Figure 3C:
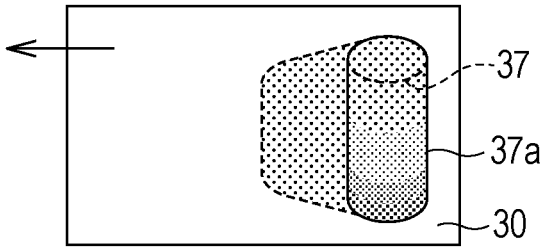
FIG. 3C is a schematic view illustrating a state where the waste ink is dispersed in the horizontal direction from the state as illustrated in FIG. 3B.

Subsequently, the decompression pump 34 is driven in a state where the waste ink is dispersed to the ink absorbing materials 30 in the up-down direction. With this, a suction force acts on the ink absorbing materials 30 at an upper left end as illustrated in FIG. 3C. Then, the suction force acting on the ink absorbing materials 30 also acts on the waste ink contained in the ink absorbing materials 30. Therefore, the waste ink dispersed as indicated by a solid line is dispersed in the ink absorbing materials 30 in the horizontal direction as indicated by a dotted line in FIG. 3C. In FIGS. 3A to 3C, regions where the waste ink is not dispersed are illustrated on upper and lower portions for making the drawings understood easily. In practice, the waste ink on the ink absorbing materials 30 is dispersed so as to be elongated in the up-down direction over the substantially entire region of the ink absorbing materials 30 in the up-down direction. Therefore, if the waste ink is dispersed to the ink absorbing materials 30 in the horizontal direction, the waste ink is dispersed to the ink absorbing materials 30 in the horizontal direction over the substantially entire region of the ink absorbing materials 30 in the up-down direction. To be more specific, the waste ink is dispersed to the ink absorbing materials 30 in the horizontal direction from a right-side portion as illustrated in FIG. 3C. If the above operations are repeated, the ink absorbing materials 30 absorb the waste ink over an extensive range. Accordingly, the ink absorbing materials 30 can hold more waste ink efficiently.

It is to be noted that the ink absorbing material 30 located at the uppermost side to which the decompression tube 35 is connected among the plurality of ink absorbing materials 30 accommodated in the waste ink tank 28 may be set to have a larger suction force for the waste ink than other ink absorbing materials 30 located at the lower side. For example, an ink absorbing material having a small porosity or an ink absorbing material having a large ink retention capability is used for the ink absorbing material 30 located at the uppermost side. Such ink absorbing material 30 has a high suction force but has a low permeability (fluidity). In contrast, the ink absorbing material 30 located at the lower side has a low suction force but has a high permeability (fluidity). In the embodiment, since the suction force acts on the upper left portion, the suction force is difficult to act on the ink absorbing materials 30 located at the lower side in comparison with the ink absorbing material 30 located at the upper side. However, since the ink absorbing materials 30 located at the lower side have a high permeability (fluidity), the waste ink is dispersed to the ink absorbing materials 30 at the lower side even in such a state. In contrast, although the ink absorbing material 30 located at the upper side has a low permeability, the waste ink is dispersed to the ink absorbing material 30 located at the upper side since the suction force largely acts on the ink absorbing material 30. In this manner, the waste ink can be made to be absorbed through an extensive portion on the ink absorbing materials 30.

According to the above embodiment, the following effects can be obtained.

(1) Discharged ink is dispersed not only by the gravity force and the permeation capability of the ink absorbing materials 30 but also by the suction force acting on the ink absorbing materials 30. Therefore, the discharged ink can be permeated into and dispersed to regions to which the discharged ink is difficult to be dispersed by the gravity force and the permeation capability. Accordingly, the ink absorbing materials 30 can sufficiently absorb the waste ink.

(2) The decompression pump 34 disperses the waste ink received on the reception portion 37 to the upper side in the vertical direction against the gravity force in the ink absorbing materials 30. Therefore, the waste ink can be dispersed to more upper side in comparison with a case of dispersion to the upper side in the vertical direction without the suction force. Accordingly, the ink absorbing materials 30 can sufficiently absorb the waste ink.

(3) A strong suction force acts on waste ink which is farther from the reception portion 37 and is difficult to permeate into the ink absorbing materials 30 and a weak suction force acts on waste ink which is closer to the reception portion 37 and is easy to permeate into the ink absorbing materials 30. Therefore, the waste ink can be made to permeate into the entire ink absorbing materials 30.

(4) Permeation by the suction force is faster than permeation by the gravity force or the permeation capability. Therefore, the waste ink can be made to permeate into an extensive range of the ink absorbing materials 30 for a shorter period of time.

It is to be noted that the above first embodiment may be changed to the following variations.

In the above first embodiment, the decompression pump 34 may be driven while the discharged waste ink is dispersed to the lower side in the vertical direction by the gravity force or may be driven immediately after the waste ink has been discharged.

Figure 4:
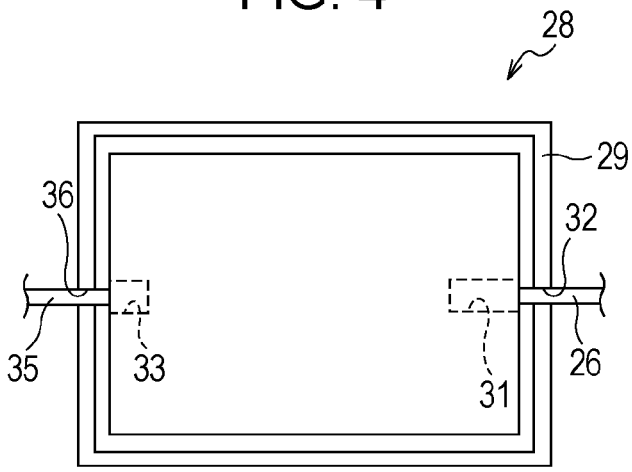
FIG. 4 is a schematic view illustrating a maintenance unit according to a variation on the first embodiment, which is seen from above.

In the above first embodiment, as illustrated in FIG. 4, the recess 31 and the recess 33 may be opposed to each other in the lengthwise direction of the upper surface of the ink absorbing material 30.

In the above first embodiment, the recess 31 may be formed on a side surface of the second ink absorbing material 30 from the top among the laminated ink absorbing materials 30.

In the above first embodiment, heights of the recess 31 and the recess 33 may be different from each other. Further, the recess 33 may be formed on a side face of the ink absorbing material 30 other than the ink absorbing material 30 located at the uppermost side among the laminated ink absorbing materials 30. However, it is desirable that the recess 31 and the recess 33 are formed at the upper side with respect to a center position of the laminated ink absorbing materials 30 in the height direction.

Second Embodiment

Next, a second embodiment of the invention is described with reference to FIG. 5 and FIGS. 6A to 6C. It is to be noted that the second embodiment is different from the first embodiment in a connection mode of the discharge tube 26 and the decompression tube 35 with respect to the tank main body 29. Accordingly, in the following description, a configuration of the second embodiment which is different from the first embodiment is mainly described and the same reference numerals in this embodiment denote the configurations which are the same and equivalent to those in the first embodiment and description thereof is not repeated.

Figure 5:
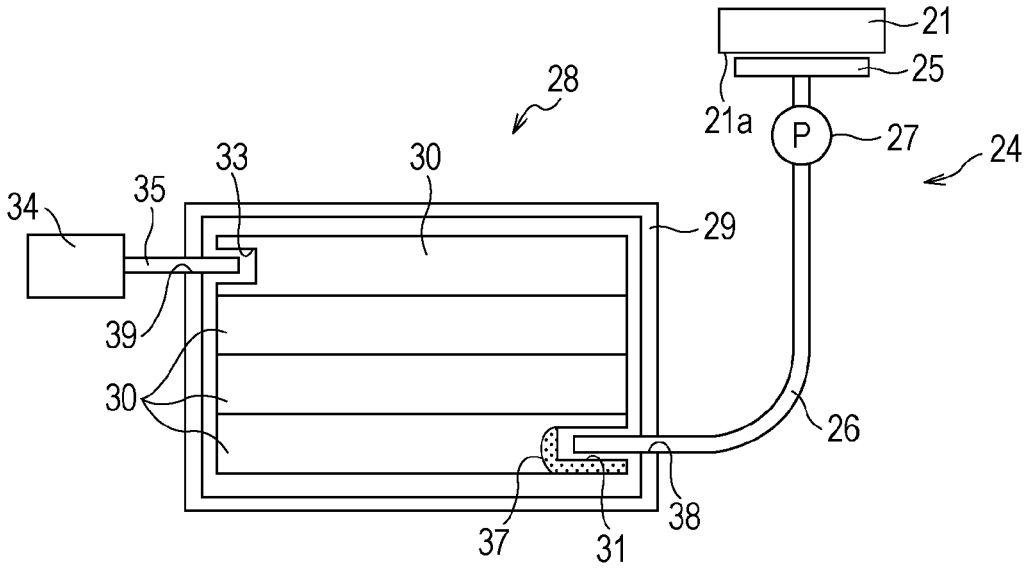
FIG. 5 is a schematic view illustrating a maintenance unit according to a second embodiment.

As illustrated in FIG. 5, in the embodiment, the recess 31 is formed on a side face of the ink absorbing material 30 located at a lowermost side among the plurality of ink absorbing materials 30 accommodated in the tank main body 29. Further, the front end of the discharge tube 26 is inserted into the recess 31 of the ink absorbing material 30 through a through-hole 38 formed on the side face of the tank main body 29. On the other hand, the recess 33 is formed on the side face of the ink absorbing material 30 located at the uppermost side among the plurality of ink absorbing materials 30 accommodated in the tank main body 29. The recess 33 is formed on the side surface opposed to the side surface on which the recess 31 is formed. Further, the front end of the decompression tube 35 is inserted into the recess 33 of the ink absorbing material 30 through a through-hole 39 formed on the side surface of the tank main body 29. That is to say, in the embodiment, the recess 33 is located at the upper side with respect to the recess 31, and the recesses 31, 33 are formed at both sides of the ink absorbing materials 30 so as to be separated from each other in the horizontal direction.

Figure 6A:
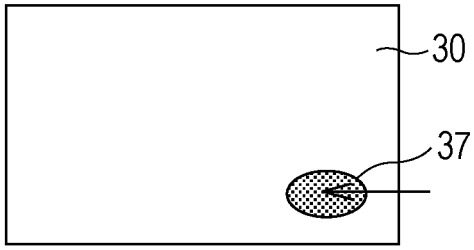
FIG. 6A is a schematic view illustrating a state immediately after waste ink has been received on an ink absorbing material.

Further, if the maintenance unit 24 executes the maintenance operation on the recording head 21, waste ink is discharged to the ink absorbing material 30 from the cap 25 through the discharge tube 26. To be more specific, the waste ink is discharged to a portion of the ink absorbing material 30 at a lower right end as illustrated in FIG. 6A. Then, the waste ink discharged to the ink absorbing material 30 is dispersed to and is sucked by the ink absorbing material 30 with a capillary force acting from the ink absorbing material 30 so that the reception portion 37 for receiving the waste ink is formed.

Figure 6B:
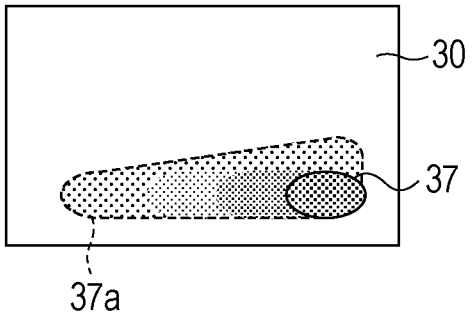
FIG. 6B is a schematic view illustrating a state where the waste ink is dispersed in the horizontal direction from the state as illustrated in FIG. 6A.

When the decompression pump 34 is not driven, the waste ink contained in the reception portion 37 is dispersed to the ink absorbing materials 30 in the horizontal direction as indicated by a dotted line in FIG. 6B because there is no space where the waste ink can move to the lower side. Further, the waste ink also permeates to the upper side but the permeation capability to the upper side becomes smaller as is farther from the reception portion 37. The waste ink on the ink absorbing materials 30 is dispersed so as to be elongated in the horizontal direction over the substantially entire region of the ink absorbing materials 30 in the right-left direction. In this case, a gradient (absorption rate) of a waste ink amount is formed on a region where the waste ink is dispersed on the ink absorbing materials 30. The gradient (absorption rate) of the waste ink amount becomes gradually smaller from the right side to the left side in FIG. 6B.

Figure 6C:
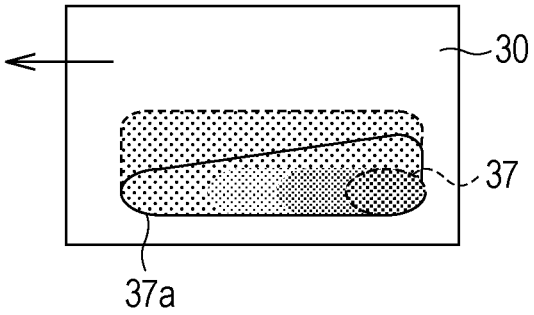
FIG. 6C is a schematic view illustrating a state where the waste ink is dispersed to the upper side in the vertical direction from the state as illustrated in FIG. 6B.

Subsequently, the decompression pump 34 is driven in a state where the waste ink is dispersed to the ink absorbing materials 30 in the horizontal direction. With this, a suction force acts on the ink absorbing materials 30 at an upper left end as illustrated in FIG. 6C. Then, the suction force acting on the ink absorbing materials 30 also acts on the waste ink contained in the ink absorbing materials 30. Therefore, the waste ink as indicated by a solid line is dispersed to the upper side in the vertical direction in the ink absorbing materials 30 as indicated by a dotted line in FIG. 6C.

A portion in which an amount of the waste ink is relatively small is arranged at the side of the recess 33 and a portion in which an amount of the waste ink is relatively large is arranged at the side of the recess 31 on the region 37*a* on which the waste ink is dispersed in the ink absorbing materials 30. Therefore, when the decompression pump 34 is driven, the suction force with the driving of the decompression pump 34 largely acts on the portion in which the amount of the waste ink is relatively small and the waste ink is difficult to be dispersed naturally to the upper side in the vertical direction.

On the other hand, the suction force is difficult to act on the portion in which the amount of the waste ink is relatively large when the decompression pump 34 is driven. As a result, the waste ink is dispersed to the upper side as is farther from the reception portion 37. Accordingly, the ink absorbing materials 30 absorb the waste ink over an extensive range so that the ink absorbing materials 30 can hold the waste ink efficiently.

Therefore, according to the embodiment, the following effect can be obtained in addition to the effects (1) to (4) obtained in the above first embodiment.

(5) A suction force which disperses the waste ink received on the reception portion 37 to the upper portion in the vertical direction against the gravity force and also disperses the waste ink in the direction farther from the reception portion 37 acts on the recess 33 of the ink absorbing material 30. Accordingly, the ink absorbing materials 30 absorb the waste ink through an extensive portion on the ink absorbing materials 30 so that the ink absorbing materials 30 can sufficiently absorb the waste ink.

It is to be noted that the above second embodiment may be changed to the following variations.

In the above second embodiment, the decompression pump 34 may be driven while the discharged waste ink is being dispersed in the horizontal direction or may be driven immediately after the waste ink has been discharged.

In the above second embodiment, the recess 31 and the recess 33 may be opposed to each other in the lengthwise direction of the upper surface of the ink absorbing material 30.

In the above second embodiment, the recess 31 may be formed on a side surface of the second ink absorbing material 30 from the bottom among the laminated ink absorbing materials 30.

Third Embodiment

Next, a third embodiment of the invention is described with reference to FIG. 7 and FIGS. 8A to 8C. It is to be noted that the third embodiment is different from each of the above embodiments in a connection mode of the discharge tube 26 and the decompression tube 35 with respect to the tank main body 29. Accordingly, in the following description, a configuration of the third embodiment which is different from each of the above embodiments is mainly described and the same reference numerals in this embodiment denote the configurations which are the same and equivalent to those in each of the above embodiments and description thereof is not repeated.

Figure 7:
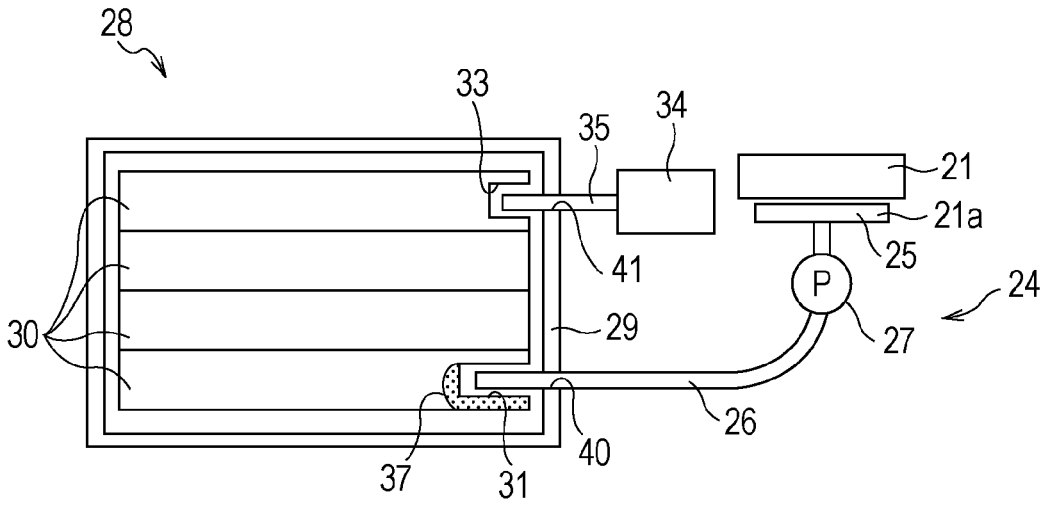
FIG. 7 is a schematic view illustrating a maintenance unit according to a third embodiment.

As illustrated in FIG. 7, in the embodiment, the recess 31 is formed on the side face of the ink absorbing material 30 located at the lowermost side among the plurality of ink absorbing materials 30 accommodated in the tank main body 29. Further, the front end of the discharge tube 26 is inserted into the recess 31 of the ink absorbing material 30 through a through-hole 40 formed on the side face of the tank main body 29. On the other hand, the recess 33 is formed on the side face of the ink absorbing material 30 located at the uppermost side among the plurality of ink absorbing materials 30 accommodated in the tank main body 29. Further, the front end of the decompression tube 35 is inserted into the recess 33 of the ink absorbing material 30 through a through-hole 41 formed on the side surface of the tank main body 29. That is to say, in the embodiment, the recess 33 is located at the upper side with respect to the recess 31, and the recesses 31, 33 are formed on the side surfaces of the ink absorbing materials 30 at the same side.

Figure 8A:
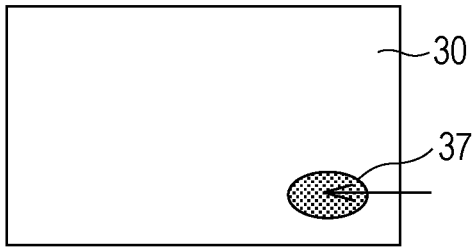
FIG. 8A is a schematic view illustrating a state immediately after waste ink has been received on an ink absorbing material.

Further, if the maintenance unit 24 executes the maintenance operation on the recording head 21, waste ink is discharged to the ink absorbing material 30 from the cap 25 through the discharge tube 26. To be more specific, the waste ink is discharged to a portion of the ink absorbing material 30 at a lower right end as illustrated in FIG. 8A. Then, the waste ink discharged to the ink absorbing material 30 is dispersed to and is sucked by the ink absorbing material 30 with a capillary force acting from the ink absorbing material 30 so that the reception portion 37 for receiving the waste ink is formed.

Figure 8B:
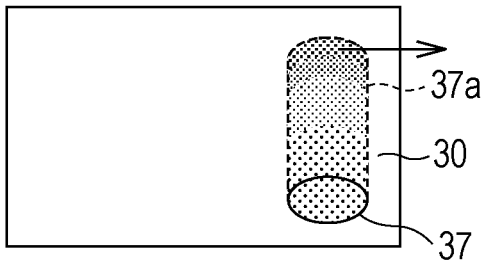
FIG. 8B is a schematic view illustrating a state where the waste ink is dispersed to the upper side in the vertical direction from the state as illustrated in FIG. 8A.

When the decompression pump 34 is driven, a suction force acts on the ink absorbing materials 30 at an upper right end portion as illustrated in FIG. 8B. Then, the suction force acting on the ink absorbing materials 30 also acts on the waste ink contained in the ink absorbing materials 30. Therefore, the waste ink contained in the reception portion 37 is dispersed to the upper side in the vertical direction against the gravity force in the ink absorbing materials 30 as indicated by a dotted line in FIG. 8B.

Then, a gradient (absorption rate) of a waste ink amount is formed on the region 37*a* where the waste ink is dispersed on the ink absorbing materials 30. The gradient (absorption rate) of the waste ink amount becomes gradually larger from the lower side to the upper side.

Figure 8C:
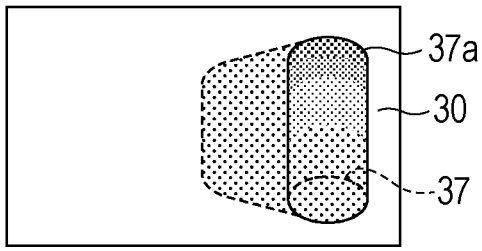
FIG. 8C is a schematic view illustrating a state where the waste ink is dispersed in the horizontal direction from the state as illustrated in FIG. 8B.

Subsequently, the driving of the decompression pump 34 is stopped in a state where the waste ink is dispersed to the ink absorbing materials 30 in the up-down direction. Then, the waste ink dispersed as indicated by a solid line is dispersed to the ink absorbing materials 30 in the horizontal direction as indicated by a dotted line in FIG. 8C. In FIG. 8C, regions on which the waste ink is not dispersed are illustrated on upper and lower portions for making the drawings understood easily. In practice, the waste ink on the ink absorbing materials 30 is dispersed so as to be elongated in the up-down direction over the substantially entire region of the ink absorbing materials 30 in the up-down direction. Therefore, if the waste ink is dispersed to the ink absorbing materials 30 in the horizontal direction, the waste ink is dispersed to the ink absorbing materials 30 in the horizontal direction over the substantially entire region of the ink absorbing materials 30 in the up-down direction. To be more specific, the waste ink is dispersed to the ink absorbing materials 30 in the horizontal direction from a right-side portion as illustrated in FIG. 8C. If the above operations are repeated, the ink absorbing materials 30 absorb the waste ink over an extensive range. Accordingly, the ink absorbing materials 30 can hold more waste ink efficiently.

Therefore, according to the embodiment, the following effect can be obtained in addition to the effects (1), (2) and (4) obtained in the above first embodiment.

(6) The suction force acts on the recess 33 of the ink absorbing material 30 such that the waste ink received on the reception portion 37 is dispersed to the upper side in the vertical direction against the gravity force. Then, the ink absorbing materials 30 disperse the waste ink dispersed in the up-down direction in the direction to be farther from the reception portion 37 in the horizontal direction. Accordingly, the ink absorbing materials 30 absorb the waste ink through an extensive portion on the ink absorbing materials 30 so that the ink absorbing materials 30 can sufficiently absorb the waste ink.

It is to be noted that the above third embodiment may be changed to the following variations.

In the above third embodiment, the decompression pump 34 may be started to be driven after the waste ink absorbed by the ink absorbing materials 30 has been dispersed over the substantially entire region of the ink absorbing materials 30 in the horizontal direction. In this case, an amount of the waste ink dispersed to the ink absorbing materials 30 varies in the horizontal direction. Therefore, even if the decompression pump 34 is driven, the waste ink is not dispersed to the upper left portion as illustrated in FIG. 7. However, if the waste ink is dispersed to the ink absorbing materials 30 in the horizontal direction after the driving of the decompression pump 34 has been stopped, the waste ink is dispersed to the substantially entire region of the ink absorbing materials 30.

Figure 9:
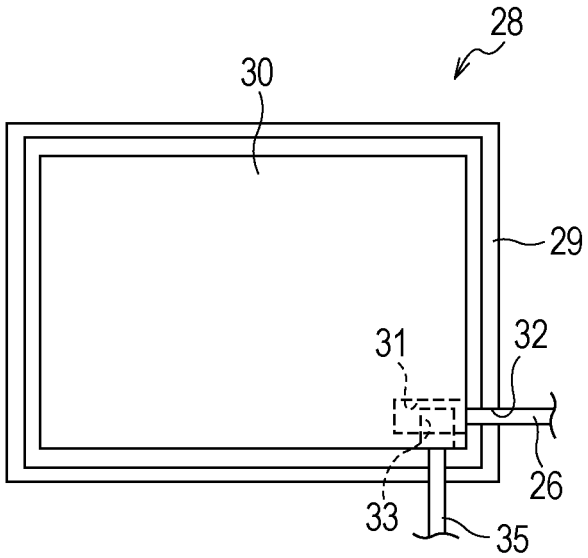
FIG. 9 is a schematic view illustrating a maintenance unit according to a variation on the third embodiment, which is seen from above.

In the above third embodiment, as illustrated in FIG. 9, the recess 31 and the recess 33 may be formed on side surfaces of the ink absorbing materials 30 at the different sides as long as the recess 31 and the recess 33 are arranged to be closer to each other when seen from above.

In the third embodiment, the recess 31 may be formed on a side surface of the second ink absorbing material 30 from the bottom among the laminated ink absorbing materials 30.

Fourth Embodiment

Next, a fourth embodiment of the invention is described with reference to FIGS. 10A and 10B and FIGS. 11A to 11C. It is to be noted that the fourth embodiment is different from each of the above embodiments in a connection mode of the discharge tube 26 and the decompression tube 35 with respect to the tank main body 29. Accordingly, in the following description, the configuration of the fourth embodiment which is different from each of the above embodiments is mainly described and the same reference numerals in this embodiment denote the configurations which are the same and equivalent to those in each of the above embodiments and description thereof is not repeated.

Figure 10A:
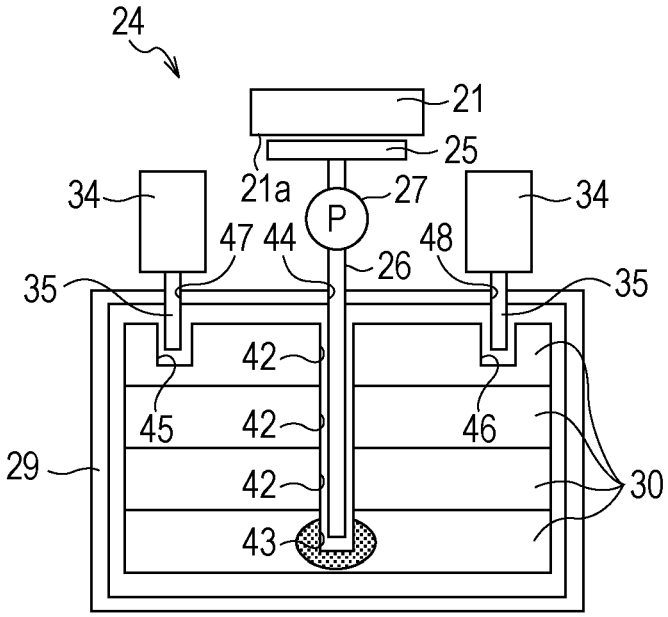
FIG. 10A is a schematic view illustrating a maintenance unit according to a fourth embodiment, which is seen from the front side.
Figure 10B:
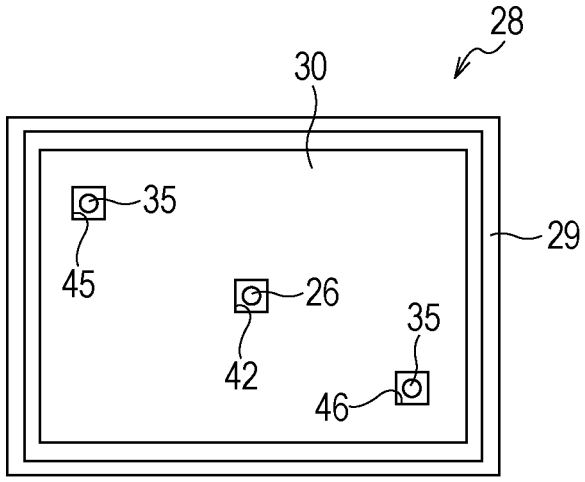
FIG. 10B is a schematic view illustrating the maintenance unit according to the fourth embodiment, which is seen from above.

As illustrated in FIGS. 10A and 10B, in the embodiment, through-holes 42 are formed in three ink absorbing materials 30 located at the upper side among the plurality of ink absorbing materials 30 accommodated in the tank main body 29. To be more specific, the through-holes 42 are formed in the three ink absorbing materials 30 at the substantially center portions. The through-holes 42 are formed so as to permeate through the ink absorbing materials 30 in the up-down direction. Further, a recess 43 is formed on the substantially center portion of the upper surface of the ink absorbing material 30 located at the lowermost side among the ink absorbing materials 30. The recess 43 is formed at a position which is identical to the positions of the above through-holes 42 when seen from above. Further, the front end of the discharge tube 26 is inserted into the through-holes 42 and the recess 43 of the ink absorbing materials 30 through a through-hole 44 formed on an upper surface of the tank main body 29.

On the other hand, a pair of recesses 45, 46 are formed on the upper surface of the ink absorbing material 30 located at the uppermost side among the plurality of ink absorbing materials 30 accommodated in the tank main body 29. To be more specific, the recesses 45, 46 are formed at positions which are point symmetry with respect to the through-holes 42. Further, front ends of the decompression tubes 35 are inserted into the recesses 45, 46 on the ink absorbing material 30 through through-holes 47, 48 formed on the upper surface of the tank main body 29, respectively. That is to say, in the embodiment, a suction force acts on the ink absorbing materials 30 from the upper side in the vertical direction at two positions sandwiching the recess 43 from both sides in the horizontal direction.

Figure 11A:
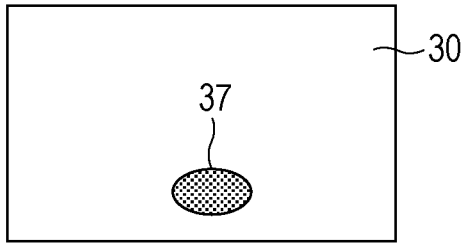
FIG. 11A is a schematic view illustrating a state immediately after waste ink has been received on an ink absorbing material.

Further, if the maintenance unit 24 executes the maintenance operation on the recording head 21, waste ink is discharged to the ink absorbing material 30 from the cap 25 through the discharge tube 26. To be more specific, the waste ink is discharged to a portion of the ink absorbing material 30 at a substantially center portion of a lower end as illustrated in FIG. 11A. Then, the waste ink discharged to the ink absorbing material 30 is dispersed to and is sucked by the ink absorbing material 30 with a capillary force acting from the ink absorbing material 30 so that the reception portion 37 for receiving the waste ink is formed.

Figure 11B:
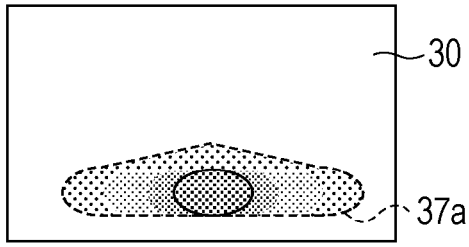
FIG. 11B is a schematic view illustrating a state where the waste ink is dispersed in the horizontal direction from the state as illustrated in FIG. 11A.

When the decompression pumps 34 are not driven, the waste ink contained in the reception portion 37 is dispersed to the ink absorbing materials 30 in the horizontal direction as indicated by a dotted line in FIG. 11B because there is no space where the waste ink can move to the lower side. The waste ink in the ink absorbing materials 30 is dispersed so as to be elongated in the horizontal direction over the substantially entire region of the ink absorbing materials 30 in the right-left direction. Further, the waste ink also permeates to the upper side but the permeation capability to the upper side becomes smaller as is farther from the reception portion 37. In this case, a gradient (absorption rate) of a waste ink amount is formed on the region 37*a* where the waste ink is dispersed on the ink absorbing materials 30. The gradient (absorption rate) of the waste ink amount becomes gradually smaller from the center portion at the lower end to both of the left and right sides in FIG. 11B.

Figure 11C:
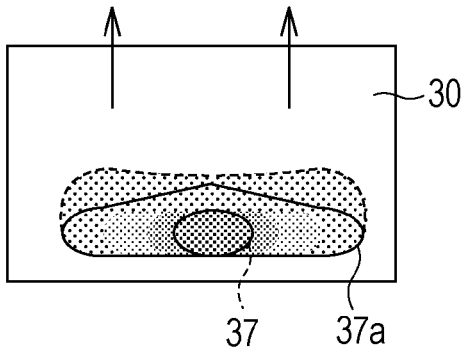
FIG. 11C is a schematic view illustrating a state where the waste ink is dispersed to the upper side in the vertical direction from the state as illustrated in FIG. 11B.

Subsequently, the decompression pumps 34 are driven in a state where the waste ink is dispersed to the ink absorbing materials 30 in the horizontal direction. With this, a suction force acts on the ink absorbing materials 30 at an upper left end and an upper right end as illustrated in FIG. 11C. Then, the suction force acting on the ink absorbing materials 30 also acts on the waste ink contained in the ink absorbing materials 30. Therefore, the waste ink as indicated by a solid line is dispersed to the upper side in the vertical direction against the gravity force in the ink absorbing materials 30 as indicated by a dotted line in FIG. 11C.

Portions in which an amount of the waste ink is relatively small are arranged at the side of the recesses 45, 46 on the region 37*a* on which the waste ink is dispersed in the ink absorbing materials 30. Therefore, when the decompression pumps 34 are driven, the suction force with the driving of the decompression pumps 34 largely acts on portions in which an amount of the waste ink is relatively small and the waste ink is difficult to be dispersed naturally to the upper side in the vertical direction.

On the other hand, the suction force is difficult to act on a portion in which the amount of the waste ink is relatively large when the decompression pumps 34 are driven. As a result, the waste ink is dispersed to the upper side as is farther from the reception portion 37. Accordingly, the ink absorbing materials 30 absorb the waste ink over an extensive range so that the ink absorbing materials 30 can hold the waste ink efficiently.

Therefore, according to the embodiment, the following effect can be obtained in addition to the effects (1) to (4) obtained in the above first embodiment.

(7) The suction force acts on the recesses 45, 46 of the ink absorbing material 30 such that the waste ink received on the reception portion 37 is dispersed to the upper side in the vertical direction against the gravity force at a plurality of positions sandwiching the reception portion 37 in the horizontal direction. Accordingly, the ink absorbing materials 30 absorb the waste ink through an extensive portion on the ink absorbing materials 30 so that the ink absorbing materials 30 can sufficiently absorb the waste ink.

It is to be noted that the above fourth embodiment may be changed to the following variations.

In the above fourth embodiment, the recess 43 into which the front end of the discharge tube 26 is inserted may be formed on the ink absorbing material 30 located at the upper side among the ink absorbing materials 30 accommodated in the tank main body 29. In such configuration, the waste ink discharged to the ink absorbing material 30 from the discharge tube 26 is dispersed to the lower side in the vertical direction by the gravity force in the ink absorbing materials 30. In addition, the waste ink is dispersed to the upper side in the vertical direction in accordance with the suction force acting with the driving of the decompression pumps 34 in the ink absorbing materials 30. Accordingly, the ink absorbing materials 30 absorb the waste ink through an extensive portion thereof so that the ink absorbing materials 30 can sufficiently absorb the waste ink.

Figure 12:
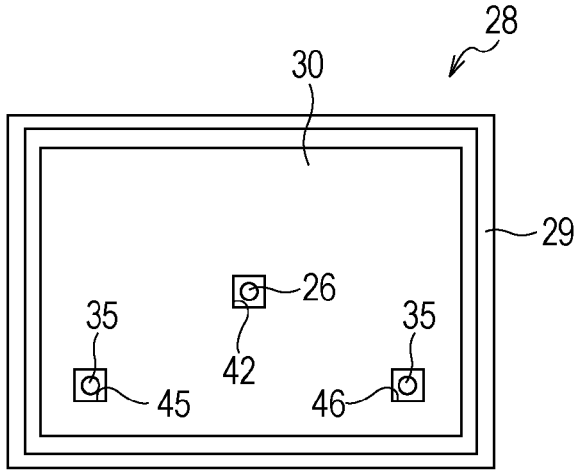
FIG. 12 is a schematic view illustrating a maintenance unit according to a variation on the fourth embodiment, which is seen from above.

In the above fourth embodiment, as illustrated in FIG. 12, both of the recesses 45, 46 into which the front ends of the decompression tubes 35 are inserted may be formed on the upper surface of the ink absorbing material 30 at one side in the short-side direction thereof when seen from the discharge tube 26.

In the above fourth embodiment, the decompression pumps 34 may be driven while the discharged waste ink is being dispersed in the horizontal direction or may be driven immediately after the waste ink has been discharged.

In the above fourth embodiment, the decompression tube 35 may be branched into a plurality of tubes from the side of the decompression pump 34 and be inserted into both of the recesses 45, 46. In this case, the suction force can be made to act on the waste ink in the ink absorbing materials 30 through both of the recesses 45, 46 using the single decompression pump 34.

It is to be noted that each of the above embodiments may be changed to the following other embodiments.

Figure 13A:
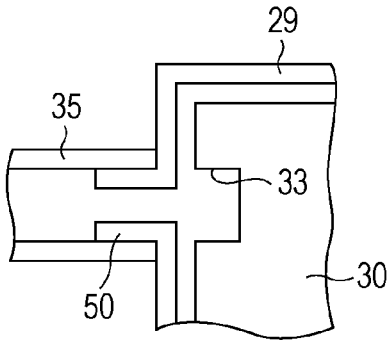
FIGS. 13A to 13C are enlarged views schematically illustrating the main part of a maintenance unit according to another embodiment.

In each of the above embodiments, as illustrated in FIG. 13A, a tubular projection 50 projecting to the outer side may be provided on the tank main body 29 and the decompression tube 35 may be fitted into the projection 50.

Figure 13B:
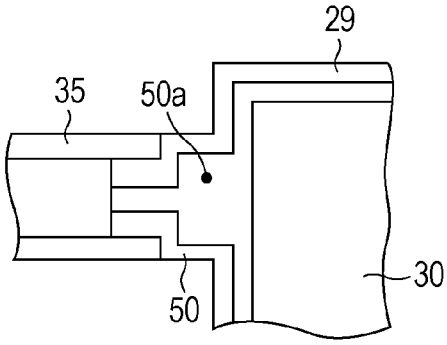
Figure 13C:
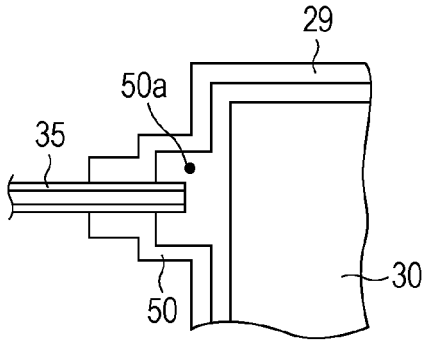

Further, a space region 50*a* may be formed at the inner side of the projection 50. In this case, the decompression tube 35 may be fitted into the projection 50 as illustrated in FIG. 13B or the decompression tube 35 may be inserted into the space region 50*a* of the projection 50 as illustrated in FIG. 13C.

In these configurations, the projection 50 functions as a connecting portion which connects the decompression pump 34 and the tank main body 29 and the space region 50*a* at the inner side of the projection 50 functions as a suction action portion which makes a suction force act on the ink absorbing materials 30.

In each of the above embodiments, the number of laminated ink absorbing materials 30 can be arbitrary. Further, a single ink absorbing material 30 may be used without laminating the ink absorbing materials 30. It is to be noted that in each of the above embodiments, a configuration in which a space is provided between the ink absorbing materials 30 and the tank main body 29 is illustrated in FIG. 2A, FIG. 5, FIG. 7, or FIG. 10A. However, such space is not necessarily required to be provided between the ink absorbing materials 30 and the tank main body 29.

In each of the above embodiments, the recesses 31, 43 into which the discharge tube 26 is inserted and the recesses 33, 45, 46 into which the decompression tube 35 is inserted may not be provided. Further, cut-out portions may be provided instead of the recesses 31, 43 and the recesses 33, 45, 46.

In each of the above embodiments, the tank main body 29 may be detachably attached to the printer 11.

Figure 14:
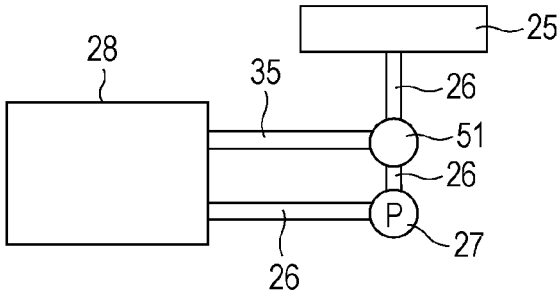
FIG. 14 is a schematic view illustrating a maintenance unit according to more another embodiment.

In each of the above embodiments, as illustrated in FIG. 14, a switching valve 51 may be provided in a middle position of the discharge tube 26 which connects the cap 25 and the suction pump 27, and the decompression tube 35 may be connected to the switching valve 51. In this case, if the switching valve 51 switches a communicating state of the suction pump 27 with respect to the cap 25 and the decompression tube 35, the suction pump 27 also serves as the decompression pump 34. Further, in this configuration, if the decompression tube 35 sucks the waste ink tank 28, the sucked waste ink is discharged to the waste ink tank 28 again through the discharge tube 26 and is sucked by the ink absorbing materials 30.

In each of the above embodiments, a liquid ejecting apparatus which ejects and discharges liquids other than ink may be employed as the liquid ejecting apparatus. The invention can be applied to various types of liquid consumption apparatuses including a liquid ejecting head which discharges a trace amount of liquid droplets, and the like. In this case, the terminology "liquid droplets" represents a state of liquid which is discharged from the above liquid ejecting apparatus. For example, a granule form, a teardrop form, and a form that pulls tails in a string-like form therebehind are included as the liquid droplets. The terminology "liquid" here represents materials which can be ejected by the liquid consumption apparatus. For example, any materials are included as long as the materials are in a liquid phase. For example, materials in a liquid state having high viscosity or low viscosity or a fluid state such as sol, gel water, other inorganic solvents, an organic solvent, a solution, a liquid resin or a liquid metal (molten metal) can be included as the liquid. Further, the liquid is not limited to liquid as one state of a material but includes a solution, dispersion or a mixture of particles of a functional material made of a solid material such as pigment particles or metal particles. Typical examples of the liquid are ink described in the above embodiments and the like. The terminology "ink" here encompasses various fluid compositions such as common aqueous ink and oil-based ink, gel ink, hot melt ink and so on. Specific examples of the liquid consumption apparatus include a liquid ejecting apparatus which ejects liquid in forms of dispersion or a solution of a material such as an electrode material or a coloring material. The material such as the electrode material or the coloring material is used for manufacturing liquid crystal displays, electroluminescence (EL) displays, surface light emitting displays and color filters, for example. Further, the specific examples of the liquid consumption apparatus include a liquid ejecting apparatus which ejects a bioorganic material used for manufacturing biochips, a liquid ejecting apparatus which ejects liquid used as a precision pipette and serving as a sample, printing equipment, a micro dispenser and so on. Other examples of the liquid consumption apparatus include a liquid ejecting apparatus which pinpoint-ejects lubricating oil to a precision machine such as a watch, a camera or the like. Further, a liquid ejecting apparatus which ejects a transparent resin solution of an ultraviolet curable resin or the like onto a substrate in order to form a hemispherical microlens (optical lens) used for an optical communication element and the like is included as the liquid consumption apparatus. In addition, a liquid ejecting apparatus which ejects an acid or alkali etching solution for etching a substrate or the like may be employed as the liquid consumption apparatus.

The entire disclosure of Japanese Patent Application Nos. 2010-210513, filed Sep. 21, 2010, 2011-136008, filed Jun. 20, 2011 are expressly incorporated by reference herein.

What is claimed is:

1. A liquid collection container which is capable of collecting discharged liquid, comprising:

a liquid absorbing material which absorbs the discharged liquid;

a suction action portion which makes a suction force act on the liquid absorbing material, and a reception portion which receives the discharged liquid and extends inwardly from a first side surface of the liquid absorbing material, wherein the suction action portion is located on a second side surface side of the liquid absorbing material that is opposite to the first side surface, the suction action portion being opposed to the reception portion in a diagonal direction, wherein the suction action portion extends inwardly from the second side surface of the liquid absorbing material.

2. The liquid collection container according to claim 1, wherein the height of the suction action portion in the vertical direction is higher than the height of the reception portion.

3. The liquid collection container according to claim 2, wherein the suction action portion and the reception portion are provided at both sides of the liquid absorbing material so as to be separated from each other in the horizontal direction.

4. The liquid collection container according to claim 3, wherein the suction action portion and the reception portion are provided on both side surfaces of the liquid absorbing material in the horizontal direction, and the suction action portion is provided at the same height as the reception portion.

5. The liquid collection container according to claim 3, wherein the suction action portion and the reception portion are provided on both side surfaces of the liquid absorbing material in the horizontal direction, and the suction action portion is provided at an upper position with respect to the reception portion.

6. The liquid collection container according to claim 2, wherein the suction action portion and the reception portion are provided on the same side surface of the liquid absorbing material, and the suction action portion is provided at an upper position with respect to the reception portion.

7. The liquid collection container according to claim 2, wherein the suction action portion makes a suction force act on the liquid absorbing material from the upper side in the vertical direction at a plurality of positions sandwiching the reception portion in the horizontal direction.

8. A liquid ejecting apparatus comprising:

a liquid ejecting head which ejects liquid onto a target;

the liquid collection container according to claims 1;

a discharge portion which sucks the liquid from the liquid ejecting head and discharges the liquid to the liquid collection container; and a suction unit which generates a suction force on the liquid collection container.

9. A liquid collection container which is capable of collecting discharged liquid, comprising:

a liquid absorbing material which absorbs the discharged liquid;

a suction action portion which makes a suction force act on the liquid absorbing material, and a reception portion which receives the discharged liquid, wherein the suction action portion is located on a second side surface side of the liquid absorbing material that is opposite to a first side surface, the suction action portion being opposed to the reception portion in a diagonal direction, wherein the suction action portion extends inwardly from the second side surface of the liquid absorbing material, wherein the suction action portion provides to the discharged liquid that is farther away from the reception portion a suction force that is stronger than the suction force provided to the discharged liquid that is closer to the reception portion.

* * * * *